US005367800A

United States Patent [19]

Nelson

[11] Patent Number: 5,367,800

[45] Date of Patent: Nov. 29, 1994

[54] INTERCHANGEABLE DISPLAY SYSTEM

[75] Inventor: Allan R. Nelson, Mordialloc, Australia

[73] Assignee: Chain Reaction Sales Promotion Pty. Ltd., Victoria, Australia

[21] Appl. No.: 869,432

[22] Filed: Apr. 15, 1992

[30] Foreign Application Priority Data

Mar. 6, 1992 [AU] Australia ..... PL1246

[51] Int. Cl.[5] ..... G09F 7/02

[52] U.S. Cl. ..... 40/18; 40/622; 40/5

[58] Field of Search ..... 40/5, 649, 657, 618, 40/621, 622

[56] References Cited

U.S. PATENT DOCUMENTS

| | | | |
|---|---|---|---|
| 356,062 | 1/1887 | Evans | 40/618 |
| 2,795,876 | 6/1952 | Hayes | 40/622 |
| 3,142,124 | 7/1964 | Ownbey | 40/618 |
| 4,184,277 | 1/1980 | Larin | 40/621 |
| 4,367,604 | 1/1983 | Porter, II et al. | 40/618 |
| 5,224,610 | 7/1993 | Veazey | 40/618 |

FOREIGN PATENT DOCUMENTS

| | | | |
|---|---|---|---|
| 755402 | 8/1956 | United Kingdom | 40/618 |

*Primary Examiner*—Kenneth J. Dorner
*Assistant Examiner*—Cassandra Davis
*Attorney, Agent, or Firm*—Juettner Pyle Lloyd & Piontek

[57] ABSTRACT

An interchangeable display system including a mounting for a display element, the mounting including a support backing and upper, center and lower face panels mounted to the support backing and spaced forwardly of the support backing with two elongated slots extending lengthwise between the respective face display elements and which cooperates with the upper slot, and a lower mounting hook on the back of the display element cooperates with the lower slot so that the two hooks retain the display element and can slide along the respective slots to assemble and disassemble the display element in position in front of the mounting. The display element itself may have face panels separated by a slot so that a superimposed display element provided with a mounting hook on the back thereof can be mounted in front of the display element.

6 Claims, 3 Drawing Sheets

INTERCHANGEABLE DISPLAY SYSTEM

Figure 1:
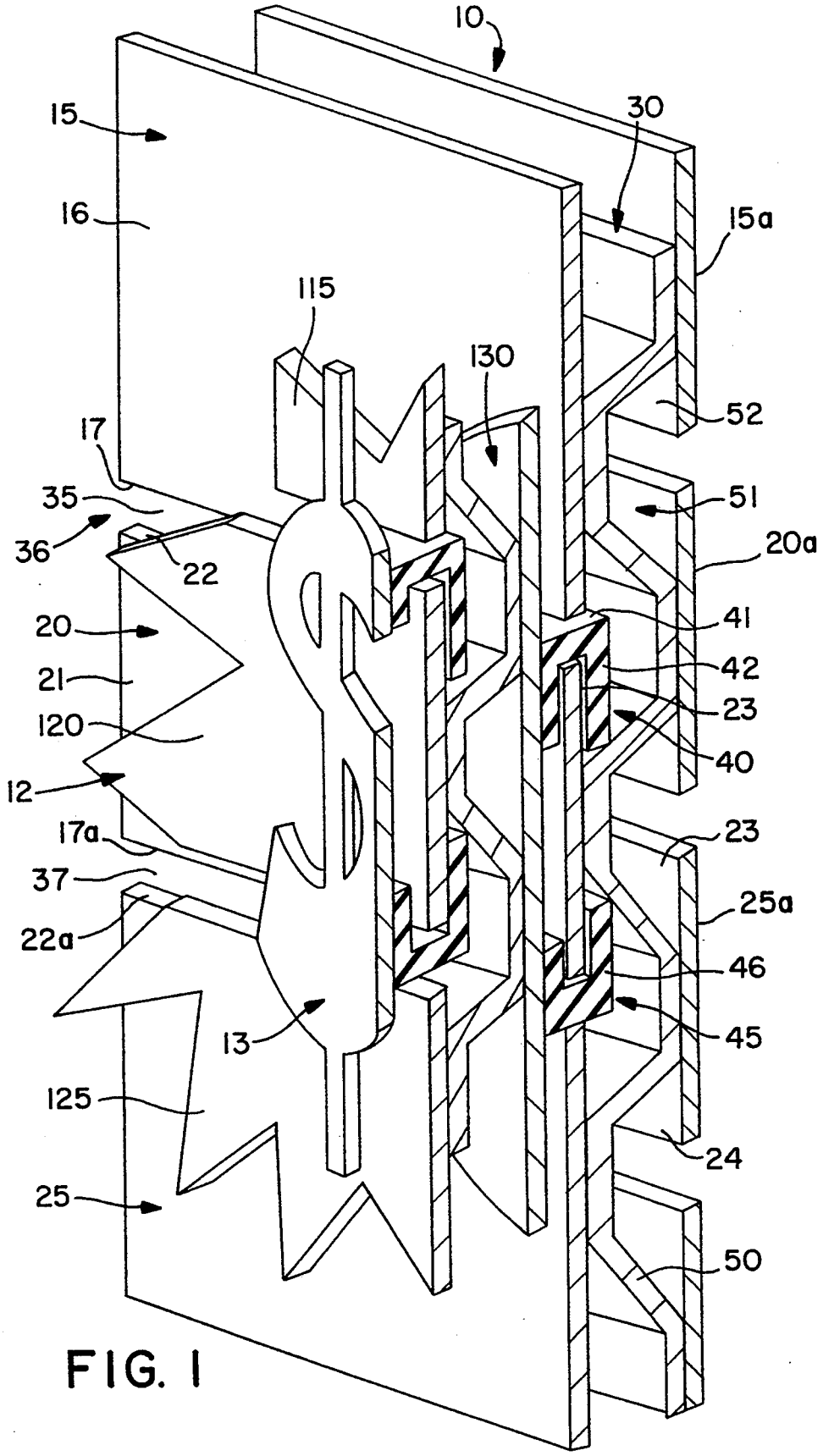

This invention relates to display systems such as display systems of the kind used in supermarkets and other retail or wholesale merchandise outlets for the purpose of displaying information or promotional material.

There are many display systems known for the purpose of enabling interchange of the display elements, such as product information, price information, and/or graphic material for information or promotional purposes. One known kind of display system utilises two parallel hook shaped extrusions which face each other and enable a display strip to be inserted lengthwise into the extrusions. The display strip element carries the required display matter. A limitation of this system is the restriction of the height of the display element to the separation between the facing extrusions. This lack of versatility of the mounting system for the display elements generally limits the use of this kind of display system to use in displaying product and price information normally at the front edge of supermarket display shelves and the like.

Larger displays, e.g. for displaying product or pricing information for goods displayed in an open location or as a free standing display generally utilise simple display placards. Such placards are usually mounted by any convenient fixing means to any suitable support. Such display systems are generally used only for one particular product display and therefore are not versatile by using interchangeable elements.

Another display system that does use interchangeable elements comprises a mounting board having a number of horizontal grooves spaced at equal distances apart. Individual alphabetic or numeric characters having tabs projecting from the rear faces thereof can be individually mounted to the board by pressing the tabs into the grooves in the board so as to be held by an interference fit. This system, although using interchangeable and reusable elements, is tedious to use and also is generally very limited in visual appeal.

It is an object of the present invention to provided an interchangeable display system which enables easy mounting and dismounting of display elements to display information or provide a visually striking or appealing display.

An interchangeable display system according to the present invention includes a mounting for a display element, the mounting comprising an upper face panel having a front face and an elongated lower edge, a lower face panel having a front face and an elongated upper edge, the mounting further including a support backing, the upper and lower face panels being mounted to the support backing so that the upper edge of the lower face panel is spaced forwardly of the support backing so as to define an undercut formation and so that the lower edge of the upper face panel and the upper edge of the lower face panel are spaced apart to define an elongated slot which extends lengthwise along the face panels to an end of the face panels where there is an open end of the slot, the display system further including a mounting hook which in use is mounted on the back of a display element, the mounting hook having a rearwardly extending leg to pass through the slot and also having a downwardly turned foot to locate behind the undercut formation and thereby retain the display element against removal by pulling the display element outwardly away from the mounting or by lifting of the display element, the mounting hook being assembled to the mounting by passing through the open end of the slot and by sliding of the hook along the slot to locate the display element at its final desired position in front of the mounting.

The display element in one embodiment is composed of an upper face panel and a lower face panel which are spaced apart to define an elongated display element slot extending lengthwise along the face panels to an edge of the face panels where there is an open end of the display element slot, the display element slot being defined between an upper edge of the lower face panel of the display element and a lower edge of the upper face panel of the display element and the upper egde of the lower face panel of the display element being spaced forwardly of a support backing of the display element so as to define an undercut formation, whereby the display element provides a mounting for a superimposed display element provided with a mounting hook on the back of the superimposed display element, the mounting hook of the superimposed display element having a rearwardly extending leg to pass through the display slot element and also having a downwardly turned foot to locate behind the undercut formation of the display element.

The present invention also provides an interchangeable display system including a mounting for a display element, the mounting comprising a upper face panel having a front face and an elongated lower edge, a centre face panel having a front face and an elongated upper edge and an elongated lower edge, and a lower face panel having a front face and an elongated upper edge, the mounting further including a support backing, the upper, centre and lower face panels being mounted to the support backing so that the upper edge of the centre face panel is spaced forwardly of the support backing so as to define an undercut formation and so that the lower edge of the upper face panel and the upper edge of the centre face panel are spaced apart to define an elongated upper slot which extends lengthwise along the face panels to an end of the face panels where there is an open end of the upper slot, the centre and lower face panels being mounted to the support backing so that the lower edge of the centre face panel is spaced forwardly of the support backing so as to define an upper undercut formation and so that the lower edge of the centre face panel and the upper edge of the lower face panel are spaced apart to define a elongated lower slot which extends lengthwise along the face panels to an edge of the face panels where there is an open end of the lower slot. The display system further includes an upper mounting hook which in use is mounted on the back of a display element, the upper mounting hook having an rearwardly extending leg to pass through the upper slot and also having a downwardly turned foot to locate behind the undercut formation of the upper slot and thereby retain the display element, the display system further including a lower mounting hook which in use is mounted on the back of the diplay element and is spaced below the upper mounting hook by a distance equal to the separation of the upper and lower slots, the lower mounting hook having a rearwardly extending leg to pass through the lower slot and also having an upwardly turned foot to locate behind the upper undercut formation of the lower slot and thereby retain the display element, the upper and lower mounting hooks being removably assembled to the mounting by passing through the respective open ends of the upper and lower slots and by sliding of the hooks along the respective slots to locate the display element at its final desired position in front of the mounting.

The support backing may be provided with a concavity adjacent each slot, the undercut formations being defined by the respective panel edges overlapping the concavity in the support backing.

In one embodiment, the support backing comprises a corrugated backing member with the corrugations extending horizontally so that each corrugation defines a respective concavity.

The corrugated backing member may have a front to which the upper face panel, centre face panel and lower face panel are mounted as front face panels, the corrugated backing member having a back along which back corrugations extend so as to define concavities, the display system further including back face panels mounted to the back of the corrugated backing member so that the back face panels are spaced apart and define elongated slots along the corrugations and which are arranged to receive mounting hooks in the same manner as the slots defined between the front face panels.

In a second embodiment the support backing comprises a support post which is arranged to be generally upright in use, the support post having concavities formed along its height and arranged so that the undercut formations are defined by mounting of the face panels to the support post so that the respective edges of the face panels overlap the concavities in the support post.

In a third embodiment, the support backing comprises a spacing bracket having a concavity, the spacing bracket having respective adjacent face panels mounted thereto with the undercut formation being defined by the respective one of the face panels overlapping the concavity in the spacing bracket. The spacing bracket may have a front and the concavity may be provided in the front of the spacing bracket with adjacent face panels being mounted to the front of the spacing bracket, the spacing bracket having a back which is provided with a back concavity whereby back face panels are mounted to the back of the spacing bracket with one of the back panels overlapping the back concavity so as to define an undercut formation extending along a slot defined between adjacent spaced edges of the back face panels and whereby the display system provides a mounting for display elements at both the front and the back of the spacing bracket. In this system, the spacing bracket comprises a generally H shaped elongated strip having a front web and a back web and a transverse connection, each of the front web and back web having a respective central recessed section set back from the general plane of the respective web so as to thereby define the respective concavity, the face panels being mounted to the webs so that slots between the adjacent spaced edges of the face panels extend along in front of the recessed sections. The transverse connection of the spacing bracket may have a hollow formation in transverse section and an open mouth at an end of the elongated spacing bracket, the display system further including a mounting bracket having a tongue which slides through the mouth and into the hollow formation of the spacing bracket, the mounting bracket having a projecting portion which extends in use beyond the side edge of the mounting and is capable of being fixed to an external structure whereby the mounting and the display element can be mounted to the structure so as to project outwardly in cantilever fashion from the structure.

In a fourth embodiment, the support backing comprises a spacing bracket having the concavity, the undercut formation being defined by overlapping of the respective panel edge over the concavity, the spacing bracket having an upper mounting web to which one of the face panels is mounted and a lower mounting web substantially coplanar with the upper mounting web and to which the immediately lower face panel is mounted, the upper and lower mounting webs being separated by a recessed section defining the concavity, the spacing bracket further including at least one rearwardly extending projection to space the mounting webs forwardly of an adjacent structure to which the spacing bracket is mounted, the spacing bracket further including a hook extending rearwardly beyond the projection whereby the hook can be mounted to a complementary formation in the structure to which the spacing bracket is mounted thereby supporting the spacing bracket and the face panels.

In a fifth embodiment, each face panel has a spacing projection extending from its rear side, the spacing projection maintaining the respective edges of the panels spaced from the support backing to thereby define the respective undercut formations.

In a further possible errangement, each face panel has a stepped edge defining the undercut formation. Each face panel may be stepped at both its edges so as to define undercut formations at both the upper and lower edges of the face panel.

Figure 2:
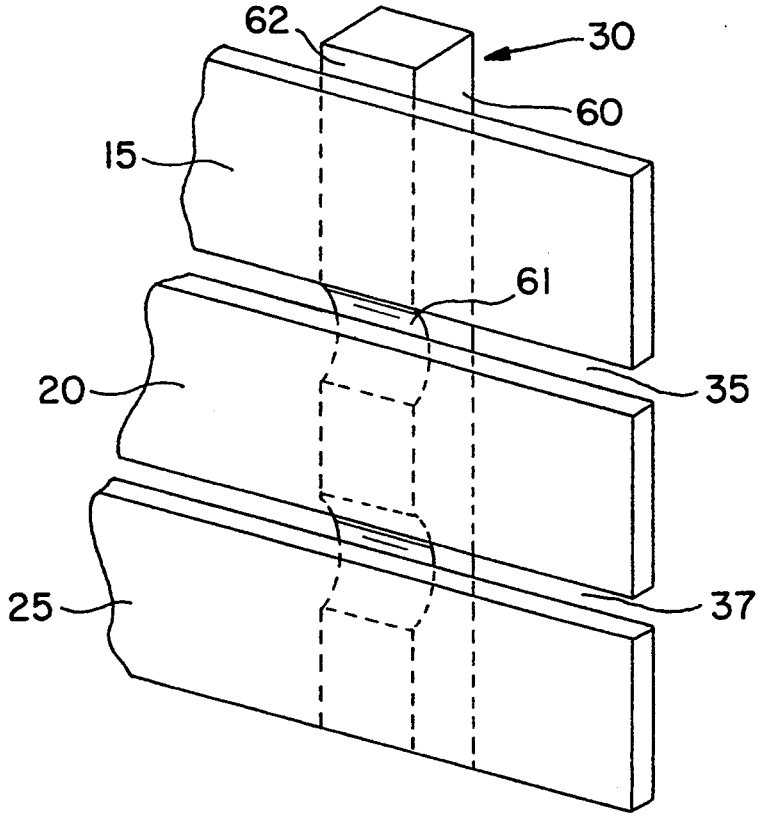
Figure 3:
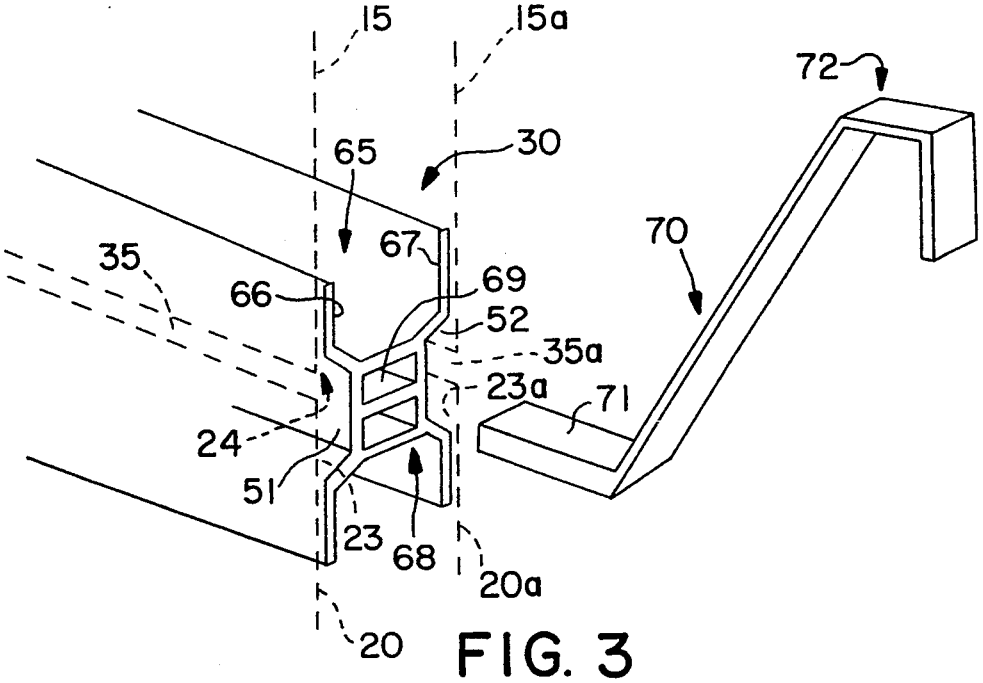
Figure 4:
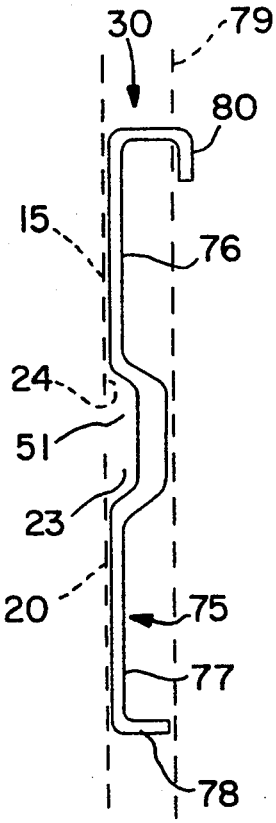
Figure 5:
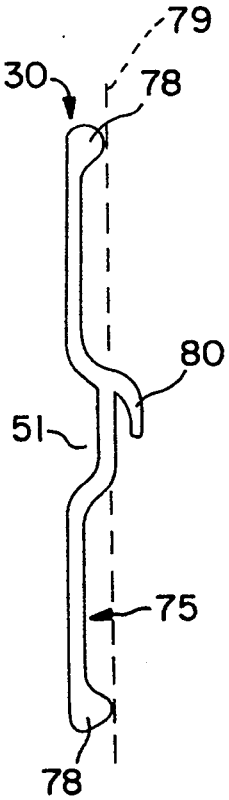
Figure 6:
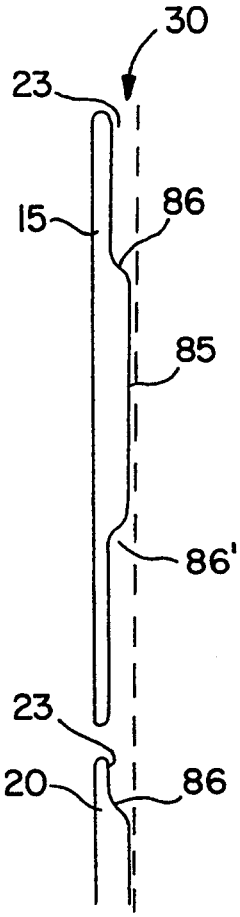

Possible and preferred features of the present invention will now be described with particular reference to the accompanying drawings. However it is to be understood that the features illustrated in and described with reference to the drawings are not to be construed as limiting on the scope of the invention. In the drawings:

FIG. 1 shows a display system according to a preferred embodiment of the invention which is sectioned vertically to illustrate the invention, FIG. 2 shows a further embodiment of the display system embodying the present invention, FIG. 3 illustrates a spacing bracket as usable in the display system, FIGS. 4 and 5 illustrate two possible alternative constructions of spacing brackets, and FIG. 6 shows a possible construction of a face panel which can be used without a concave mounting support.

The interchangeable display system in FIG. 1 includes a mounting 10 for a display element 12. The mounting 10 comprises an upper face panel 15 having a front face 16 and an elongated lower edge 17. A centre face panel 20 (lower than the panel 15) has a front face 21 and an elongated upper edge 22. The mounting 10 further includes a support backing 30, the upper and centre face panels 15, 20 being mounted to the support backing 30 so that the upper edge 22 of the centre face panel 20 is spaced forwardly of the support backing 30 so as to define an undercut formation 23 and so that the lower edge 17 of the upper face panel 15 and the upper edge 22 of the centre face panel 20 are spaced apart to define an elongated upper slot 35 which extends lengthwise along the face panels 15, 20 to an end of the face panels where there is an open end 36 of the slot 35. A mounting hook 40 is mounted on the back of the display element 12, the mounting hook 40 having a rearwardly extending leg 41 to pass through the slot 35 and also having a downwardly turned foot 42 to locate behind the undercut formation 23 and thereby retain the display element 12 against removal by pulling the display element outwardly away from the mounting or by lifting of the display element. The mounting hook 40 is assembled to the mounting 10 by passing through the open end 36 of the slot 35 and by sliding of the hook 40 along the slot to locate the display element 12 at its final destined position in front of the mounting 10.

It will be understood that the face panels 15, 20 may be of any convenient shape and size. Illustrated is the most simple display system in which the face panels 15, 20 are generally rectangular with the edges thereof extending horizontally and the panels themselves in use being generally vertical. The lower edge 17 of the upper face panel 15 and the adjacent upper edge 22 of the centre face panel 20 are substantially parallel so that the slot 35 has a constant width and extends horizontally.

As shown is FIG. 1, there can be provided three or more face panels 15, 20, 25, each face panel having an adjacent face panels spaced a short distance therefrom so that each adjacent pair of face panels define a respective slot 35, 37 for receiving a respective mounting hook.

The support backing 30 may be of any suitable construction. In FIG. 1, the backing 30 comprises a corrugated backing member 50 with the corrugations extending horizontally so as to define concavities 51, 52. The face panels 15, 20, 25 may be adhered or fastened to the corrugated backing member 50 so that the adjacent pair of face panels 15, 20 or 20, 25 have their adjacent edges overlapping one of the horizontally extending concavities 51 thereby defining the associated undercut formation 23 and defining slot 35, 37 for receiving mounting hook 40. With this arrangement, several face panels 15, 20, 25 can be mounted to the backing member 50 so that there are two or more slots 35, 37 extending along horizontally on the concave backing. This enables display elements 12 to be selectively mounted at different heights as desired.

In another possible embodiment shown in FIG. 2, the support backing 30 comprises a simple post 60 having concave formations 61 in a front edge 62, the face panels 15, 20, 25 being mounted to the front edge 62 so that where the adjacent face panels are spaced apart by a short distance to define the associated slots 35, 37, the slots register with the respective formations 61 in the post 60 so that mounting hooks can slide along the slots and pass into and, if desired, through and beyond the concave formations 61 in the post 60.

In FIG. 3, the support backing 30 comprises a spacing bracket 65 having a concavity 51. Face panels 15, 20 are mounted to the bracket 65 with the undercut formation 23 being defined by the face panel 20 overlapping the concavity 23. The spacing bracket 65 has the concavity 51 provided in the front of the bracket 65. The bracket 65 also has a back which is provided with a back concavity 52 so that back face panels **15*a*, 20*a* are mounted to the back of the bracket 65 with one or, as illustrated, both of the back panels 15*a*, 20*a* overlapping the back concavity 52 to define undercut formations 23*a*. Slots 35, 35*a*extending along both the front and back of the bracket 65** provide for mounting of display elements.

The spacing bracket 65 comprises a generally H shaped elongated strip, such as an extrusion, having a front web 66 and a back web 67 and a transverse connection 68. The front and back webs 66, 67 both have central recessed sections set back from the general plane of the respective web so as to define the respective concavities behind the slots **35, 35*a*. The transverse connection 68 has a hollow formation in transverse section and has an open mouth 69 at an end of the elongated bracket 65. A mounting bracket 70 has a tongue 71 which slides through the mouth 69 and into the hollow formation of the bracket 65. The mounting bracket 70 has a projecting portion 72 which extends in use beyond the assembly of the bracket 65 and associated panels 15, 20, 15*a*, 20*a*** and is arranged to be fixed to an external structure so that the assembly can be mounted to the structure so as to project outwardly in cantilever fashion from the structure.

In FIGS. 4 and 5, the support backing 30 comprises a spacing bracket 75 having the concavity 51. The undercut formation 23 is defined by overlapping of the upper edge of the panel 20 over the concavity 51. The bracket 75 has an upper mounting web 76 to which the panel 15 is mounted and a lower mounting web 77 coplanar with the upper mounting web 76 and to which the panel 20 is mounted. The upper and lower mounting webs 76, 77 are separated by a recessed section defining the concavity 51. Rearwardly extending projections 78 serve to space the mounting webs 76, 77 forwardly of an adjacent structure 79 to which the bracket 75 is mounted. The rear face of the recessed section which defines the concavity 51 also functions in the same manner as the projection 78 to space the webs 76, 77 forwardly of the structure 79. A hook 80 extends rearwardly beyond the projection 78 so that the hook 80 can be mounted to a complementary formation in the structure 79 thereby supporting the spacing bracket 75 and the face panels 15, 20. In FIG. 4, the hook 80 is provided at the top edge of the bracket 75 and in FIG. 5 hook 80 is provided behind the recessed section defining the concavity 51. The brackets 75 in both FIG. 4 and 5 may be extrusions composed of a plastics material or metal.

In FIG. 6, the face panels 15, 20 each have a spacing projection 85 extending from their respective rear faces, the projections 85 maintaining the respective edges of the panels 15, 20 spaced from the support backing 30 to thereby define the respective undercut formations 23. In FIG. 6, each face panel 15, 20 has a stepped edge 86 defining the undercut formations. The stepped edges 86 are provided at both upper and lower edges of the panels 15, 20 so as to define undercut formations at both the upper and lower edges of the panels.

In another embodiment (not illustrated), the concave backing may comprise a generally U shaped bracket to which the adjacent face panels are mounted so that the bracket supports the face panels in spaced and coplanar relationship.

If desired, as shown in FIGS. 1, 3 and 4, the lower edge 17 of the upper face panel 15 may also overlap the concavity 51 so as to define an upper undercut formation 24 in the respective concavity 51. With this arrangement, a mounting hook 45 may pass through the mouth and have a foot 46 which is turned upwardly to locate behind the upper undercut formation 24. In FIG. 1 the system includes a mounting hook 40 on the back of the display element 12, the mounting hook 40 having a turned down foot 42 to locate within upper slot 35 defined between lower edge 17 of upper face panel 15 and the upper edge 22 of centre face panel 20. The system further includes a lower mounting hook 45 having an upwardly turned foot 46 which engages in lower slot 37 defined between the lower edge **17*a* of the centre face panel 20 and the upper edge 22***a* of the lower face panel 25 so that the upper and lower slots 35, 37 are substantially parallel and can receive respectively the upper mounting hook 40 and the lower mounting hook 45 enabling the display element 12 to be moved horizontally along the mounting 10. With this arrangement, the upper mounting hook 40 carries the weight of the display element 12 and prevents the display element 12 being pulled at the top thereof away from the mounting 10, while the lower mounting hook 45 is engaged through the lower slot 37 and retains the lower portion of the display element 12 against being drawn outwardly away from the mounting 10. This arrangement restricts the assembly of the display element 12 to the only possible mode of mounting, namely sliding the display element 12 along from a side edge of the face panels 15, 20, 25.

The display element 25 may comprise for example graphic, alphanumeric or pictorial matter. The simple mounting of the display elements 12 by sliding them onto the mounting 10 from an edge enables particularly simple mounting and dismounting of the display elements 12 and interchange of the display elements with other display elements. In the possible embodiment shown in FIG. 1, the display element 12 is itself composed of face panels 115, 120, 125, the face panels having adjacent edges spaced apart and overlapping a concave backing 130. With this arrangement, the display element 12 itself serves as a mounting for a further superimposed display element 13 which has mounting hooks projecting rearwardly to mount the display element 13 in the same manner as the mounting of the display element 12. This enables layers of display elements to be built up one upon the other thereby enhancing the ability to provide visually striking displays and/or effective communication of information.

It will be seen that the display system of the present invention can provide double sided mounting. That is, there may be provided at least two face panels 15, 20, 25 on one side of the support backing 30, the opposite or back side of the backing 30 providing further concavities which are associated with two or more back face panels 15*a*, 20*a*, 25*a* which overlap the concavities at the back side of the backing 30. This arrangement can be readily achieved with the backing 30 in the form of a horizontally corrugated core 50 providing concavities on opposite faces thereof (FIG. 1) or with mounting brackets 65 recessed on both sides (FIG. 3). Thus the display system can be free-standing with display elements mounted on both sides of the mounting 10.

It will be seen that the preferred embodiment of the display system as herein described and illustrated can enable the simple mounting and replacement of a sign element by sliding the mounting hook into the end of the slot defined between the adjacent edges of the face panels. The mounting hook holds the display element securely against accidental dislodgement except by sliding the display elements the length of the slot to disengage the mounting hook from the slot. The system can enable layers of superimposed sign elements to be built up. Also the sign elements can be provided on opposite sides of a vertical mounting having front face panels on one side and back face panels on the other.

The display system as particularly described and illustrated can be made from a simple and inexpensive materials. The fabrication of the display system, including both the mounting comprising the face panels and the concave backing can be simple, rapid and relatively inexpensive. The mounting hooks and display elements can be made of simple and cheap materials. For example, the mounting hooks may be defined by lengths of generally U shaped plastics extrusion. The face panels of the mounting can be made of any desired material such as plywood or composite board.

It is to be understood that various alterations, modifications and/or additions may be made to the features of the possible and preferred embodiment(s) of the invention as herein described without departing from the scope of the invention as defined in the claims.

I claim:

1. An interchangeable display system including a mounting and a display element, the mounting comprising an upper face panel having a front face and an elongated lower edge, a lower face panel having a front face and an elongated upper edge, the mounting further comprising a support backing, the upper and lower face panels being mounted to the support backing so that the upper edge of the lower face panel is spaced forwardly of the support backing so as to define an undercut formation and so that the lower edge of the upper face panel and the upper edge of the lower face panel are spaced apart to define an elongated mounting slot which extends lengthwise along the face panels to an end of the face panels where there is an open end of the mounting slot, the display element comprising a back and a mounting hook which is mounted on the back of the display element, the mounting hook having a rearwardly extending leg to pass through the mounting slot and also having a downwardly turned foot to locate behind the undercut formation and thereby retain the display element against removal by pulling the display element outwardly away from the mounting or by lifting of the display element, the mounting hook being assembled to the mounting by passing through the open end of the mounting slot and by sliding of the hook along the mounting slot to locate the display element at its final desired position in front of the mounting, the display element additionally comprising an upper face panel and a lower face panel which are spaced apart to define an elongated display element slot extending lengthwise along the face panels of the display element to an edge of the face panels of the display element where there is an open end of the display element slot, the display element slot being defined between an upper edge of the lower face panel of the display element, the display element additionally comprising a support backing, both the lower face panel of the display element and the upper face panel of the display element being mounted to the support backing of the display element with a lower edge of the upper face panel of the display element and the upper edge of the lower face panel of the display element being spaced forwardly of the support backing of the display element so as to define an undercut formation, whereby the display element provides a mounting for a superimposed display element provided with a back and a mounting hook on the back of the superimposed display element, the mounting hook of the superimposed display element having a rearwardly extending leg to pass through the display element slot and also having a downwardly turned foot to locate behind the undercut formation of the display element.

2. A display system as claimed in claim 1 wherein the support backing of the mounting is provided with a concavity adjacent the mounting slot, the undercut formation at the upper edge of the lower face panel of the mounting being defined by the upper edge of the lower face panel of the mounting overlapping the concavity in the support backing.

3. A display system as claimed in claim 2 wherein the support backing of the mounting comprises a spacing bracket having a front and a concavity provided in the front of the spacing bracket with adjacent upper and lower face panels of the mounting being mounted to the front of the spacing bracket, the spacing bracket having a back which is provided with a back concavity whereby back upper and lower face panels are mounted to the back of the spacing bracket, the back upper face panel having a front face and an elongated lower edge, the back lower face panel having a front face and an elongated upper edge, wherein the lower edge of the back upper panel and the upper edge of the back lower panel are spaced apart to define a back slot with a one of the back panels overlapping the back concavity so as to define an undercut formation extending along the back slot and whereby the display system provides a mounting for display elements at both the front and the back of the spacing bracket.

4. A display system as claimed in claim 1 wherein the support backing of the mounting is provided with a concavity adjacent the mounting slot, the undercut formation at the upper edge of the lower face panel of the mounting being defined by the upper edge of the lower face panel of the mounting overlapping the concavity in the support backing, and wherein the support backing comprises a spacing bracket having said concavity, the spacing bracket having the upper and lower face panels of the mounting mounted thereto with the undercut formation at the upper edge of the lower face panel being defined by the upper edge of the lower face panel which is mounted to the spacing bracket overlapping the concavity in the spacing bracket.

5. An interchangeable display system comprising a mounting and a display element, the mounting comprising an upper face panel having a front face and an elongated lower edge, a center face panel having a front face and an elongated upper edge and an elongated lower edge, and a lower face panel having a front face and an elongated upper edge, the mounting further comprising a support backing, the upper, center and lower face panels being mounted to the support backing so that the upper edge of the center face panel is spaced forwardly of the support backing so as to define an undercut formation and so that the lower edge of the upper face panel and the upper edge of the center face panel are spaced apart to define an elongated upper slot which extends lengthwise along the upper and center face panels to an end of the upper and center face panels where there is an open end of the upper slot, the center and lower face panels being mounted to the support backing so that the lower edge of the center face panel is spaced forwardly of the support backing so as to define an upper undercut formation and so that the lower edge of the center face panel and the upper edge of the lower face panel are spaced apart to define an elongated lower slot which extends lengthwise along the center and lower face panels to an edge of the center and lower face panels where there is an open end of the lower slot, the upper and lower slots being parallel and spaced apart by a predetermined distance, the display element having a back and including an upper mounting hook which is mounted on the back of the display element, the upper mounting hook having a rearwardly extending leg to pass through the upper slot and also having a downwardly turned foot to locate behind the undercut formation of the upper slot and thereby retain the display element, the display element further including a lower mounting hook which is mounted on the back of the display element and is spaced below the upper mounting hook by a distance equal to said predetermined distance, the lower mounting hook having a rearwardly extending leg to pass through the lower slot and also having an upwardly turned foot to locate behind the upper undercut formation of the lower slot and thereby retain the display element, the upper and lower mounting hooks being removably assembled to the mounting by passing through the respective open ends of the upper and lower slots and by sliding of the hooks along the respective slots to locate the display element at its final desired position in front of the mounting, said support backing comprising a spacing bracket, a concavity in said spacing bracket adjacent each slot, adjacent face panels being mounted on said spacing bracket, with the undercut formation being defined by said adjacent face panels overlapping the concavity in the spacing bracket.

6. An interchangeable display system including a mounting and a display element, the mounting comprising an upper face panel having a front face and an elongated lower edge, a center face panel having a front face and an elongated upper edge and an elongated lower edge, and a lower face panel having a front face and an elongated upper edge, the mounting further including a support backing, the upper, center and lower face panels being mounted to the support backing so that the upper edge of the center face panel is spaced forwardly of the support backing so as to define an undercut formation and so that the lower edge of the upper face panel and the upper edge of the center face panel are spaced apart to define an elongated upper slot which extends lengthwise along the upper and center face panels to an end of the upper and center face panels where there is an open end of the upper slot, the center and lower face panels being mounted to the support backing so that the lower edge of the center face panel is spaced forwardly of the support backing so as to define an upper undercut formation and so that the lower edge of the center face panel and the upper edge of the lower face panel are spaced apart to define an elongated lower slot which extends lengthwise along the center and lower face panels to an edge of the center and lower face panels where there is an open end of the lower slot, the upper and lower slots being parallel and spaced apart by a predetermined distance, the display element having a back and including an upper mounting hook which is mounted on the back of the display element, the upper mounting hook having a rearwardly extending leg to pass through the upper slot and also having a downwardly turned foot to locate behind the under cut formation of the upper slot and thereby retain the display element, the display element further including a lower mounting hook which is mounted on the back of the display element and is spaced below the upper mounting hook by a distance equal to said predetermined distance, the lower mounting hook having a rearwardly extending leg to pass through the lower slot and also having an upwardly turned foot to locate behind the upper undercut formation of the lower slot and thereby retain the display element, the upper and lower mounting hooks being removably assembled to the mounting by passing through the respective open ends of the upper and lower slots and by sliding of the hooks along the respective slots to locate the display element at its final desired position in front of the mounting, each of the said face panels having a rear side and a spacing projection extending from its rear side, the spacing projection maintaining the respective edges of the panels spaced from the support backing to thereby define the respective undercut formations.

* * * * *